United States Patent [19]

Schnurer et al.

[11] Patent Number: 4,706,845

[45] Date of Patent: Nov. 17, 1987

[54] DIAPER DISPENSING AND DISPOSAL UNIT

[76] Inventors: David M. Schnurer; Ellen R. Schnurer, both of 2600 S. Chicago Ave., South Milwaukee, Wis. 53172

[21] Appl. No.: 877,419

[22] Filed: Jun. 23, 1986

[51] Int. Cl.[4] ..... A47F 1/08

[52] U.S. Cl. ..... 221/102; 221/304; 312/42

[58] Field of Search ..... 221/33, 34, 35, 44, 221/98, 100, 102, 92, 97, 242, 241, 304; 312/50, 60, 42, 212, 270, 296

[56] References Cited

U.S. PATENT DOCUMENTS

| | | | |
|---|---|---|---|
| 1,018,011 | 2/1912 | Shank . | |
| 1,371,331 | 3/1921 | Swift . | |
| 1,666,849 | 4/1928 | Fry | 221/242 |
| 2,617,702 | 11/1952 | Manning et al. | 312/270 X |
| 3,343,898 | 9/1967 | Larson . | |
| 4,037,756 | 7/1977 | Jaquish | 221/242 |
| 4,046,243 | 9/1977 | Valentine | 221/76 X |
| 4,096,969 | 6/1978 | Ragusa | 221/242 X |
| 4,170,325 | 10/1979 | Pawlowski et al. . | |
| 4,573,608 | 3/1986 | Hansen | 221/92 |
| 4,582,222 | 4/1986 | Johnson et al. | 221/129 |

*Primary Examiner*—F. J. Bartuska

*Attorney, Agent, or Firm*—John C. Cooper, III; Fred Wiviott; C. Thomas Sylke

[57] ABSTRACT

A unit combining a diaper dispenser and disposal drawer is shown. The unit consists of two sections, an upper dispensing section and a lower disposal section, which provide a single unit for new and soiled diapers, as well as other supplies used in changing a baby. The upper dispensing section has a number of dividers which define vertical shafts. Diapers are placed in these shafts and are removable at the bottom thereof through adjustable slots. The slots of the upper dispensing section are adjustable by using a removable shelf. The vertical shafts are also adjustable in cross-sectional size to accomodate different sized diapers. A slidable front panel permits easy access to one or more of the vertical shafts for reloading. The bottom disposal section comprises a cabinet generally rectangular in shape with a pivoting, top-opening door. This disposal section may contain a separate bin, such as a plastic bag or bucket which is easily removed to dispose of soiled diapers and other waste. The door additionally has a liner along its edges making the lower section of the unit airtight and thus odor-free. Space is also provided to allow the user to place a deodorizer within the lower section.

10 Claims, 5 Drawing Figures

DIAPER DISPENSING AND DISPOSAL UNIT

BACKGROUND OF THE INVENTION

1. Field Of The Invention

The present invention relates generally to the art of diaper dispensing units for use in a nursery area with infants or extremely small children, and more particularly to a unit designed to dispense various sizes of disposable diapers and provide a disposal unit in conjuction therewith.

2. Description Of The Related Art

It is necessary in the course of a given day for a parent or baby sitter to frequently have to change the diaper of an infant or small child. During this operation, the soiled diaper must be removed and disposed of, the child must be cleaned, certain skin care products such as lotions and powders may have to be used, all while being in close contact with the child so as to insure the child's safety. With the advent of disposable diapers, this operation usually includes having to remove diapers from large cardboard boxes on the floor which is both cumbersome and inconvenient. The inconvenience and other problems are only compounded when parents have several children to tend. A single unit to be used in a nursery or other similar area that could dispense one or more sizes of disposable diapers, provide a sanitary and odor-free disposal unit and be conveniently located to the changing area would be a great help to parents and others who must frequently change the diapers of infants and small children.

While applicants are not aware of any devices in the related areas of the art, they are aware of several devices designed to dispense flat objects. One of these devices is shown in U.S. Pat. No. 3,343,898 issued to Larson on Sept. 26, 1967. Larson shows a hygenic pad to be used by men following urination to avoid soiling their clothes or themselves. Larson discloses the hygenic pad and a means for dispensing such pads. The dispenser comprises a unit having an open vertical face with a number of tabs extending therefrom. The tabs are connected to the hygenic pads which are kept inside. A small slot is provided at the bottom of the dispensing unit to permit one pad to slide through while retaining the pads above them in their stacked position. After use, the pad may be disposed of in an open container having a trap door below. The unit is hung on a wall in a private or public restroom and, after a number of pads have been disposed of in the disposal recepticle, it is emptied by opening a trap door on the bottom. The device disclosed by Larson does not show any means for adjusting the dispensing portion of the unit for different size pads. In light of the design used for the unit, there would be no suggestion of teaching that adjustability of the size would be necessary. In addition, the lower receptacle portion is open to the air, a condition that would prove undesirable for disposing soiled diapers. Additionally, it seems unlikely that the areas of art, the hygenic pad art and the diaper art, are closely enough related to suggest any teaching across the fields.

In U.S. Pat. No. 4,170,325 issued to Pawlowski et al. on Oct. 9, 1979, a receptacle is disclosed which is designed to dispense relatively flat, rectangular articles. The dimensions of the side walls are such that the articles in stacked array assume an angular position in the carton. The bottom-most article partially protrudes through a dispensing slot provided in a side wall. Removal of the article through the slot permits the succeeding article to drop and tilt into the partially protruding position through the slot. In the Pawlowski device, great care must be taken to make sure that the dimensions of the stacking area are precise with respect to the articles to be dispensed, since the thickness of the article determines how many articles will protrude from the slot provided therein. In addition, the slot must be of a size so that the first article protrudes, while the second is held in position above. There is no teaching or suggestion in the Pawlowski patent of providing any sort of disposal unit, much less a disposal unit that will provide an airtight and convenient airtight disposal section. There is additionally no suggestion of adjustable slots. The device in Pawlowski was developed for dispensing articles such as tea bags, an area of art extremely remote from that of dispensing and disposal of diapers.

U.S. Pat. No. 1,371,331 issued to Swift on Mar. 15, 1921 shows a carton support adapted for supporting cardboard cartons containing a stack of drinking cups. The carton used in dispensing the cups is a generally rectangular box with a slot 12 cut in the bottom. A single drinking cup may be removed therefrom and the stack moves down one providing a drinking cup for use by the next user. Once again, no means for adjusting the dimensions of the dispensing carton or slot are provided, nor are they suggested in any way. Additionally, no airtight disposal unit is suggested or shown by Swift. As with the Pawlowski patent, the intended area of use is so remote from that of diaper dispensing and disposal that applicants do not consider the Swift patent of particular relevance.

Finally, U.S. Pat. No. 1,018,011 issued to Shank on Feb. 20, 1912 shows a towel cabinet designed to dispense towels and to provide means for advancing one towel after another within reach of the user. Shank provides a cabinet designed to hold a stack of towels which are dispensed one at a time by moving a lever to bring the towel out into the reach of the user. The device disclosed by Shank is considerably more complex than required or shown by the applicants. For example, each of the towels must be placed in a carton or box to be properly dispensed. As with the other patents cited by the applicants, no teaching or suggestion is made with respect to an airtight disposal unit in close proximity to the dispensing means. Additionally, applicants believe that the towel cabinet dispensing art is considered to be remote from the diaper dispensing and disposal art and therefore the Shank patent is of questionable relevance with respect to the applicants' invention.

OBJECTS AND SUMMARY OF THE INVENTION

It is a primary object of the present invention to provide a single unit for conveniently dispensing diapers and providing a disposal unit for disposing of soiled diapers cleanly.

It is a further object of the present invention to provide a diaper dispensing and disposal unit which can be conveniently located near the diaper changing area so that the person changing the child's diaper does not need to leave the child unattended for any period of time during the changing operation.

It is another object of the present invention to provide a diaper dispensing and disposal unit which can accomodate several sizes of diapers at the same time, so that a number of boxes for different sized diapers need not be kept near the changing area.

It is yet another object of the present invention to provide a diaper dispensing and disposal unit which is adjustable so that as a child grows older larger size diapers may be used therein or so several different sized diapers may be kept available at once.

It is still another object of the present invention to provide a diaper dispensing and disposal unit which provides the parent or other child attendant with an airtight, odor-free disposal location for soiled diapers.

Still another object of the present invention is to provide a diaper dispensing and disposal unit which may be compact enough to be a free standing unit on the floor, or to be a unit hung on a wall adjacent the changing area.

How these and other objects of the invention are accomplished will be described by reference to the following description of the preferred embodiment of the invention taken in conjunction with the FIGURES. Generally, however, the objects are accomplished in a unit for dispensing and disposal of diapers. The unit consists of two sections, an upper dispensing section and a lower disposal section, which provide a convenient center for clean and soiled diapers, as well as other supplies used in changing a baby. The upper dispensing section is generally rectangular and has a number of dividers which define vertical shafts within the upper section. Diapers are placed in these shafts and are removable at the bottom thereof through adjustable slots. The vertical shafts are adjustable in cross-sectional size to accomodate different size diapers. Due to the generally consistent width of disposable diapers marketed presently, the cross sectional variation is usually accomodated by adjusting only the length component of the cross sectional vertical shafts. A slidable front panel permits easy access to one or more of the vertical shafts for reloading. The bottom disposal section comprises a cabinet generally rectangular in shape with a pivoting, top-opening door. The lower disposal section may contain a separate waste receptacle such as a plastic bag or plastic bucket which is easily removed to dispose of soiled diapers. The lower disposal section additionally has a liner along the door portion so as to make the lower section of the unit airtight and thus odor-free. Adequate space is provided within the disposal section to allow the user to place a deoderizer so as to allow the user to place a deodorizer therein as well. The slots of the upper dispensing section are adjustable for various size diapers via at least one removable shelf. Other variations, applications, or modifications of the unit may appear to those skilled in the art after reading the specification. For example, the present invention may be adapted through mechanical and other means to be a commercial dispensing and disposal unit which could be placed in gas stations, rest areas, hotels, etc. to provide convenient places to change the diaper of an infant or small child while away from home. Any of these variations or modifications are deemed to fall within the scope of the present invention if they fall within the scope of the claims which follow the description of the preferred embodiment.

DESCRIPTION OF THE PREFERRED EMBODIMENT

Figure 1:
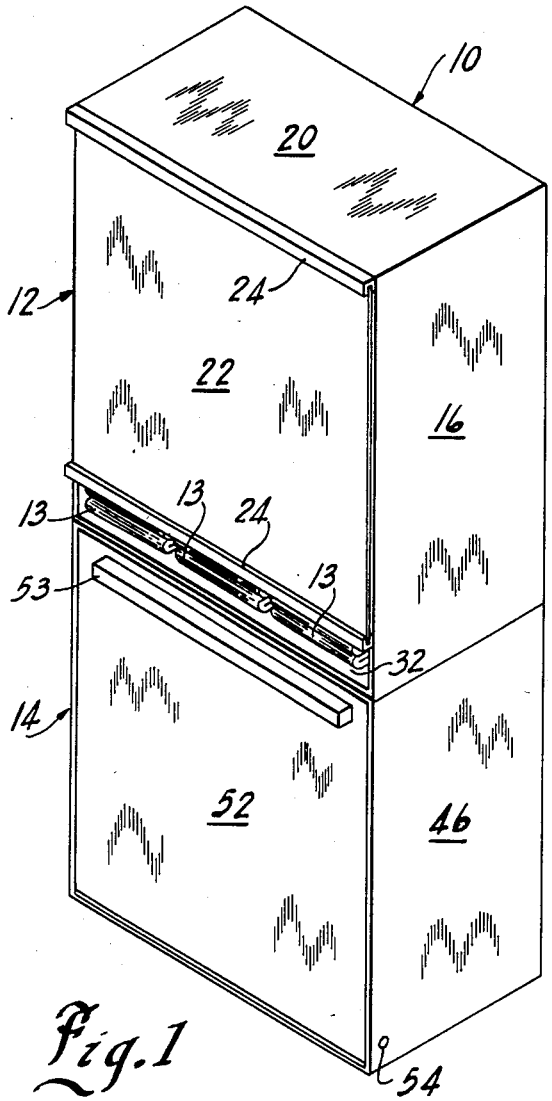
FIG. 1 is a perspective view of the preferred embodiment of the diaper dispenser and disposal unit.
Figure 2:
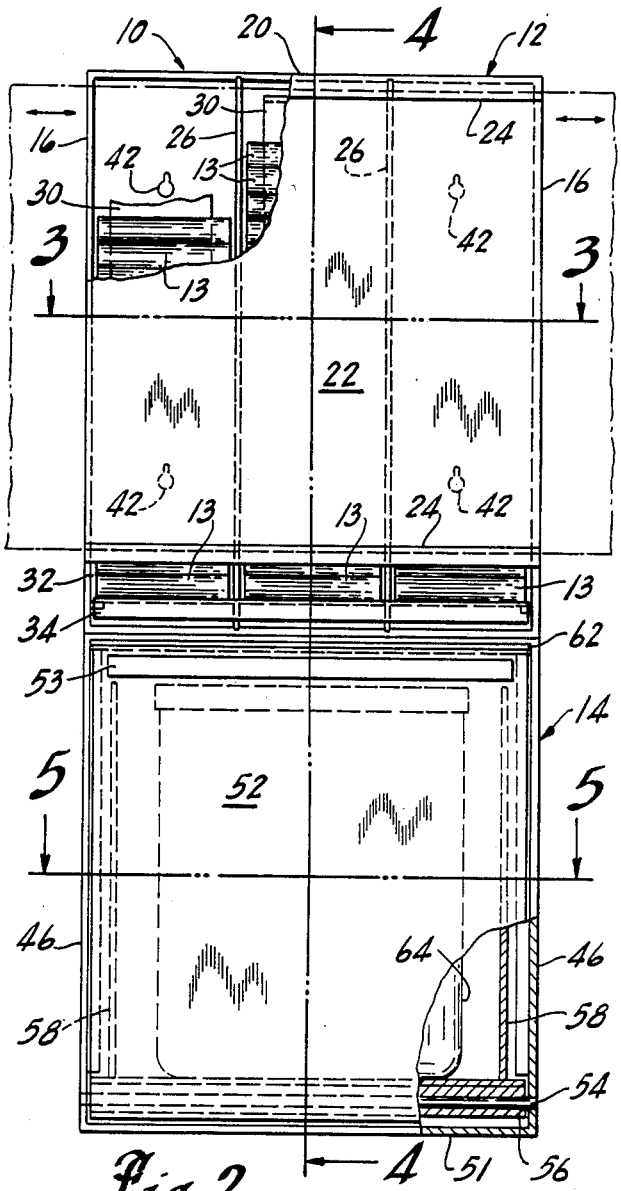
FIG. 2 is a front plan view of the diaper dispenser and disposal unit of the present invention with certain portions cut away to show internal elements of the unit.

The preferred embodiment of the present invention is generally shown in FIG. 1. In this embodiment, the dispensing and disposal unit 10 is comprised of two cabinet sections. The upper section 12 is the dispensing means for new diapers 13, while the lower section 14 is the containment means for soiled diapers. Although the unit 10 may be composed of unitary wall members, it will be described as having separate upper and lower wall members for each section for purposes of illustration.

The upper section 12 has side walls 16, a rear wall 18, a top panel 20 and a movable front panel 22. The front panel 22 is slidably movable in the preferred embodiment, panel 22 being held between slots 24 which engage both the upper and lower edges of the front panel 22. Alternatively, panel 22 can be pivotably mounted to act as a hinged door at the front of upper section 12. Moving the front panel 22 to one side or the other gives access to one or more vertical shafts within the upper section 12. When the shafts are exposed, new diapers 13 may be placed therein or removed therefrom. Front panel 22 extends from the top panel 20 down to almost the bottom edge of the upper section 12. This leaves a small slot extending across the lower front portion of the upper section 12.

This slot 32 provides access to the upper section 12 permitting removal of new diapers 13 from the cabinet. Slot 32 is adjustable in size. The size of slot 32 is adjusted by using a shelf 34 seen in FIGS. 3 and 4. In the preferred embodiment, shelf 34 is a single piece of material similar to the cabinet walls and front panel. The height of the shelf 34 is adjusted by use of protrusions 38 on the inside of side walls 16. In addition, shelf 34 has a rear leg 41 which engages lip 39, thus holding shelf 34 laterally in place when a diaper 13 is withdrawn. Adjustment of the slot size is accomplished by removing the shelf 34 using a finger hole 40 and either placing the shelf at a new level by using a different protrusion 38, or simply removing the shelf completely to allow slot 32 to assume its maximum size. In an alternate embodiment of the slot adjusting means, separate shelves can be used for each vertical shaft within the upper section 12. Such an alternate configuration would be used when wishing to individually alter the size of the shafts in upper section 12.

Figure 3:
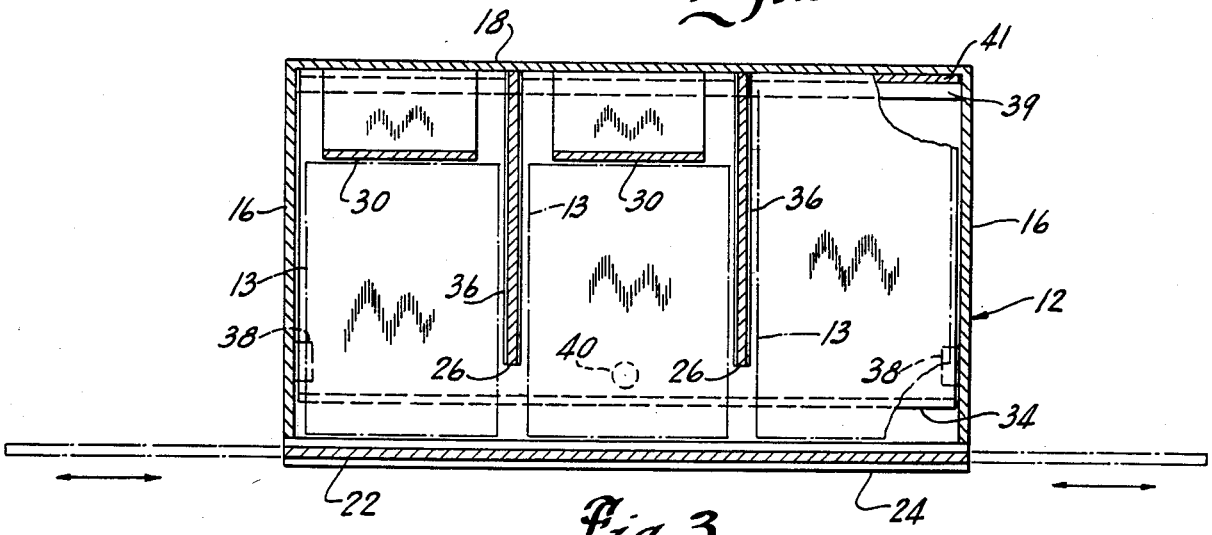
FIG. 3 is a cross-section view of the upper dispenser section of the present invention as taken along the line 3—3 of FIG. 2.

The shafts of upper section 12 are defined by a number of vertical separators or dividers 26. In the preferred embodiment, two dividers 26 are being used to create three vertical shafts in which the diapers 13 sit in vertical stacks. The dividers 26 are connected to rear wall 18 of the upper section 12 and extend almost to the front wall 22. They are typically made of a material similar to that of the upper section cabinet wall. As can be seen in FIG. 3, the shelf 34 has slots 36 which provide for the dividers 26 which extend throughout the upper section 12.

Figure 4:
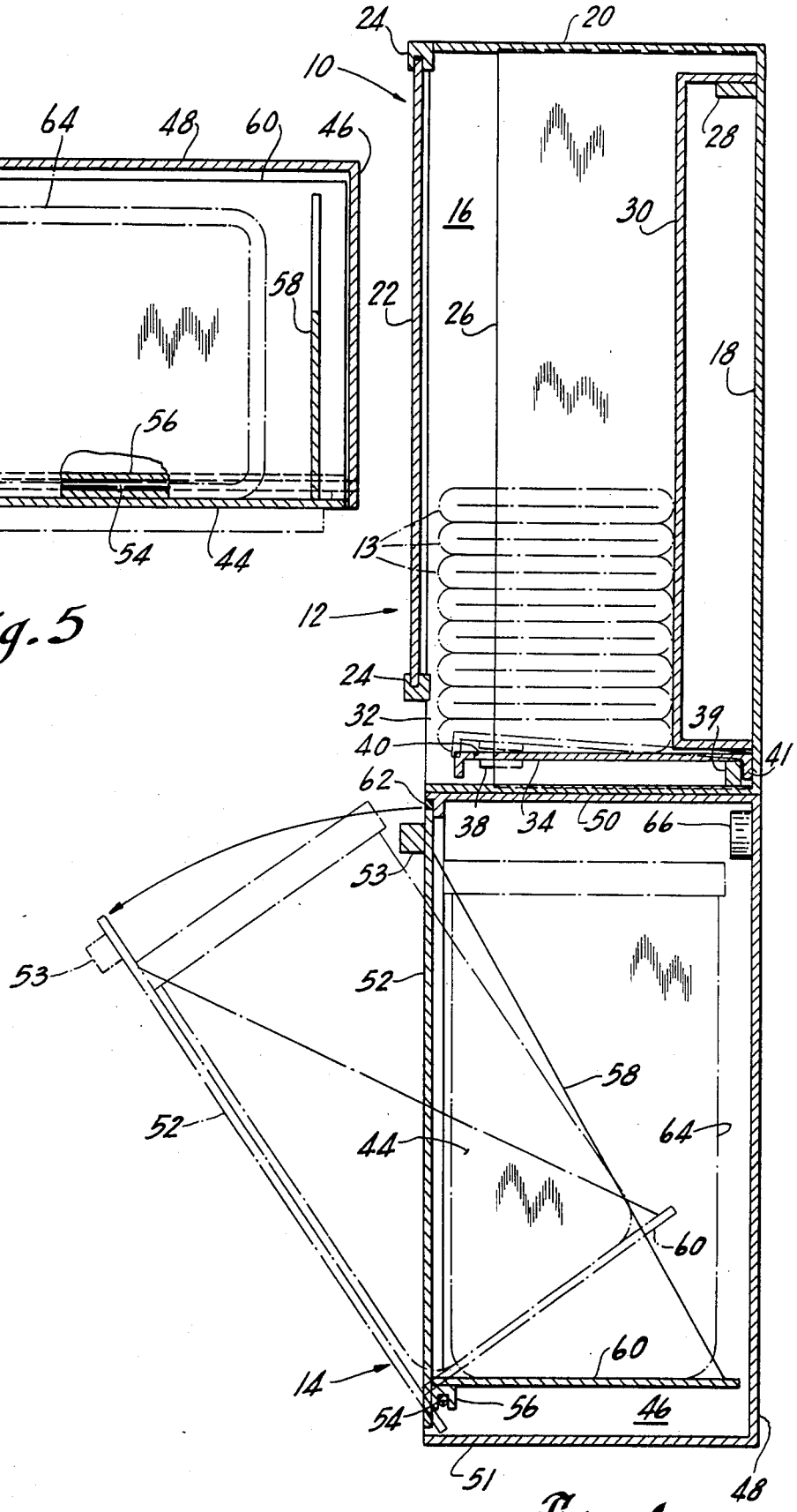
FIG. 4 is a side cross-section view of the entire diaper dispenser and disposal unit of the present invention taken along the line 4—4 of FIG. 2.

On the inside face of rear wall 18 are also found ledge members 28 which hold front spacers 30. The spacers 30 are used to ensure that the front edge of each diaper 13 at slot 32 is kept at the same point, thus making the diaper 13 always readily accessible to the user. Spacers 30 are generally C-shaped pieces which hang from ledge members 28 as seen in FIG. 4. The spacers 30 provide a forward rear wall for the shaft in which diapers 13 rest. In an alternate embodiment of the present invention, spacers may also be used with the dividers 26 to make the width of the vertical shafts adjustable as well. Because separate spacers can be used in each of the vertical shafts, each shaft may hold different size diapers and yet keep them all in the same position for removal at slot 32. Therefore, when the alternate embodiment of shelf 34 is used in conjunction with multiple spacers 30, the upper section 12 can accomodate a number of different size diapers. This is particularly useful when a number of children who wear different size diapers must be tended to on a regular basis. It is conceivable in an alternate embodiment of the invention, that a cabinet could hold in excess of three different size diapers to be used in a setting such as a commercial nursery or day care center.

Finally, the upper section 12 also has a number of holes 42 in rear wall 18. These holes are provided so that the entire dispensing and disposal unit 10 can be hung from a wall if so desired. Because of its naturally stable shape however, unit 10 is equally adaptable to be an independent floor standing cabinet. Top panel 20, is additionally a convenient place to store various lotions, powders and other supplies used in changing a child's diaper.

In the preferred embodiment of the invention, the disposal section 14 for holding soiled diapers consists of a cabinet and a drawer 44 within the cabinet. As can be generally seen in FIGS. 3 and 4, the cabinet is situated directly beneath the upper dispensing section 12 and has a top panel 50, a bottom panel 51, side walls 46 and a rear wall 48.

The drawer 44 fits within the cabinet and pivots outwardly from the top panel 50 of the lower cabinet. Drawer 44 has a door 52 with a handle 53. In alternate embodiments of the lower section 14, the door 52 can be designed so as to swing away to one side or the other. However, it has been found to be particularly easy to use this top opening door when it is necessary to be handling an infant or small child at the same time since the top-opening door has certain advantageous characteristics, such as being self-closing. The drawer 44 is opened by pulling firmly on the handle 53 at the top of the door 52.

The door 52 pivots on a rod 54 which extends across the cabinet near the front of its bottom. The drawer 44 has at least one hinge member 56 attached at its base which engages the rod 54 to permit pivoting of the drawer 44 outwardly. Any other suitable pivoting means can be employed; however, this configuration has been found quite easy to produce and permits easy disassembling of the lower disposal section 14 for cleaning or repair. As can be seen in FIG. 4, the drawer 44 moves between an open position, where the door 52 forms an angle of approximately 30° with the front of unit 10, and a closed position where the door 52 is generally flush with the front of the unit 10.

Figure 5:
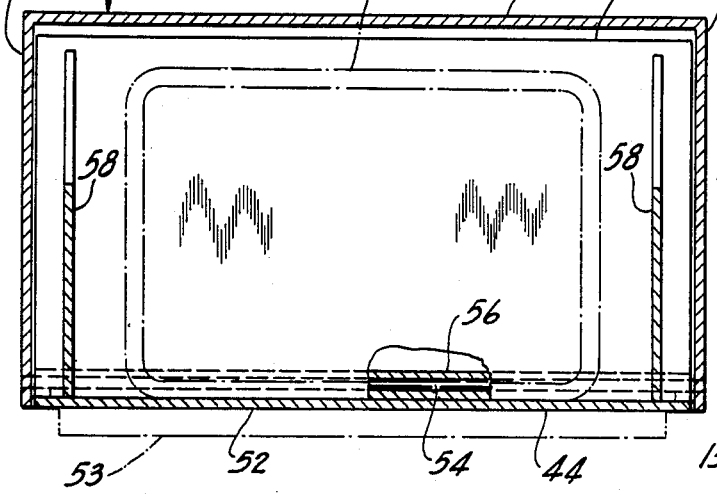
FIG. 5 is a top cross-section view of the lower disposal section of the diaper dispenser and disposal unit of the present invention taken along the line 5—5 of FIG. 2.

The disposal drawer 44 is a partial box. As can be seen in FIGS. 4 and 5, the drawer has generally triangular side walls 58 attached to the door 52. Walls 58 are parallel to and slightly inside of the cabinet side walls 46. There is additionally a floor portion 60 attached to the bottom edges of the door 52 and side walls 58. The configuration of the drawer 44 shown in the preferred embodiment has the advantage stated above of being self-closing due to the shape of side walls 58 and and the pivot point of the door 52. This is a great advantage since it is important to keep the door closed and prevent any escape of odor from the drawer 44.

Escape of odor is further inhibited by the use of lining material 62 along the edges of the door 52. Rubber stripping, or some other pliable and airtight material, can be used to line the door edges. Thus when the door 52 is closed or closes by itself, an airtight seal is formed between the door 52 and the cabinet.

Typically, a bin 64 of some sort is kept within the drawer 44. The soiled diapers are deposited in the bin 64 which is then easily removed for emptying. A plastic bag or other suitable liner may be used to avoid the need to constantly clean the bin 64 and/or drawer 44. Additionally, there is adequate space within the drawer for a deodorizer 66 of some sort to be kept. This is ordinarily not necessary since the sealing means of the door 52 keeps most odor contained.

It will be readily apparent and obvious to those skilled in the art that a number of changes and modifications may be made without departing from the spirit and scope of the present invention. For examples, various mechanical and other means could be incorporated to create a commercial dispensing and disposal unit which could be placed in gas stations, rest areas, hotels, etc. to provide convenient places to change a child's diaper while from home. Therefore, the above illustrated and described preferred embodiment is illustrative rather than limiting, the scope of the invention being limited only by the claims that follow.

We claim:

1. A diaper dispensing and disposal unit comprising:

(a) an upper dispensing section, said upper section having a rear wall, a pair of opposing side walls, and a front panel slidably movable to permit access to at least one of said vertical shafts, said upper section comprising:

at least one vertical divider, between said side walls and parallel thereto, defining a plurality of vertical shafts designed to hold a number of folded diapers in a vertical stack, adjustable slot means at the front, bottom end of each shaft permitting withdrawal of a folded diaper thereby indexing downwardly the diapers contained in said shaft to move the diaper immediately above the withdrawn diaper down to said slot means and thereby into position for subsequent withdrawal, and at least one removable spacer designed to allow adjustment of the cross-sectional spacing within a selected vertical shaft, and wherein said adjustable slot means includes at least one removable shelf that can be selectively set at different vertical levels at the bottom of said shafts to accomodate diapers of different sizes; and (b) a lower disposal section immediately below said upper section, said lower section having a top panel, a rear wall adjacent said rear wall of said upper section, a pair of opposing side walls and a bottom member, said lower section comprising:

a pivoting drawer including a door having a handle and acting as the front of said lower section, said drawer being pivotable between a first closed position and a second open position, wherein said door of said drawer in said first closed position forms a generally airtight compartment with said side walls, said rear wall of said lower section, said bottom member and said upper section, and a receptacle within said drawer.

2. The diaper dispensing and disposal unit as recited in claim 1 wherein said adjustable slot means further includes one of said shelves for each vertical shaft formed within said upper section.

3. The diaper dispensing and disposal unit as recited in claim 1 wherein said front panel is pivotably movable to permit access to at least one of said vertical shafts.

4. The diaper dispensing and disposal unit as recited in claim 1 wherein said removable spacer is attachable to the inside of said rear wall of said upper section thereby narrowing the vertical shaft defined by said vertical dividers.

5. The diaper dispensing and disposal unit as recited in claim 1 wherein said lower section further comprises a liner positioned between said door and an edge formed by said side walls of said lower section, said bottom member and said top panel of said lower section so that when said drawer is in said first closed position said lower section is generally airtight.

6. The diaper dispensing and disposal unit as recited in claim 5 wherein said liner is rubber stripping located on said door.

7. The diaper dipensing and disposal unit as recited in claim 5 wherein said liner is rubber stripping located on said edge of said lower section.

8. The diaper dispensing and disposal unit as recited in claim 1 wherein said drawer further includes a hinge element located adjacent the bottom of said door, said hinge element engaging a rod extending between said opposing side walls of said lower section, thereby allowing said drawer to pivot at the bottom thereof to said second open position.

9. The diaper dispensing and disposal unit as recited in claim 1 wherein said drawer further includes side walls adjacent said door and a floor member adjacent said side walls of said drawer and said floor member.

10. The diaper dispensing and disposal unit as recited in claim 9 wherein said drawer further includes a removable disposal receptacle which sits on said floor member.

* * * * *